United States Patent [19]

Kayson

[11] Patent Number: 4,487,158

[45] Date of Patent: Dec. 11, 1984

[54] FUSER APPARATUS

[75] Inventor: Walter Kayson, Rochester, N.Y.

[73] Assignee: Eastman Kodak Company, Rochester, N.Y.

[21] Appl. No.: 502,871

[22] Filed: Jun. 9, 1983

[51] Int. Cl.[3] ..... B05C 13/02

[52] U.S. Cl. ..... 118/60; 118/245; 271/311; 271/DIG. 2; 355/3 FU; 432/60

[58] Field of Search ..... 118/60, 245; 432/60; 271/DIG. 2, 311–313; 355/3 FU

[56] References Cited

U.S. PATENT DOCUMENTS 2,701,765 2/1955 Codichini et al. ..... 432/60

3,845,742 11/1974 Thettu ..... 118/60

FOREIGN PATENT DOCUMENTS 1456238 11/1976 United Kingdom .

*Primary Examiner*—Evan K. Lawrence

*Attorney, Agent, or Firm*—Donald D. Schaper

[57] ABSTRACT

Fuser apparatus including a fuser member movable along a continuous path having a layer with a surface for fusing a toner image carried by a support brought into contact with the fusing surface. The layer is preferably resilient and includes at least one continuous tunnel disposed beneath the surface and a self-sealing slit communicating between the tunnel and the surface. A support-separating member is provided having an end configured to penetrate the slit and to follow in the tunnel as said fuser member is moved along the continuous path to separate a support from the fuser member.

5 Claims, 6 Drawing Figures

FUSER APPARATUS

BACKGROUND OF THE INVENTION

This invention relates generally to fuser apparatus and more particularly to fuser apparatus including means for positively separating a support after fusing.

In the electrographic process, a toner image corresponding to an original is formed on a support such as a copy sheet. The toner is of heat and/or pressure fusible particles and the toner image is permanently fixed to the support by means of fuser apparatus which includes a fuser member, such as a fuser roller, which contacts a support carrying a toner image to fuse the toner image by means of heat and pressure. Since there is a tendency for a support to stick to the fuser member, a separating member is frequently employed to positively separate the support from the fuser member. The separating member has an end which may contact the surface of the fusing member or which may be disposed slightly above the surface. Such arrangements increase the danger, however, that the support will slip between the fusing member and the separating member and cause jamming of the paper and possible breakage of the end of the separating member.

In order to minimize this problem, it has been proposed to provide the surface of the fuser member with undulations or slots into which the end of the separating member penetrates. Thus, in U.S. Pat. No. 2,701,765, issued Feb. 8, 1955, for "Xerographic Fusing Apparatus," a heated drum is provided having open grooves into which stripper feelers penetrate in order to strip a fused sheet from the drum. U.S. Pat. No. 3,845,742 issued Nov. 5, 1974, for Fuser Roll Construction, discloses a fusing system including a rotatable member covered with an elastomeric material formed with undulations to accommodate stripper fingers. The undulations have a depth and width sufficient to cause a fused sheet to assume the shape of the undulations to improve sheet separation. In the apparatus of the latter two patents the slots or undulations are open so that there is a tendency for toner and other debris to accumulate in the slots. Moreover, the width of the undulations and slots may cause image defects in a fused image. Such problems are minimized somewhat in British Patent Specification No. 1,456,239, published Nov. 24, 1976, for "Fixing Device," which discloses a fuser roller having an elastomeric coating with a plurality of narrow grooves into which stripper wires or blade-like members penetrate to strip copy sheets from the roller after fusing. Although the grooves are open at the top, in an embodiment described at Page 5, Line 41 and following, the depth and width of the grooves are such that in the roller nip the sides are nipped together so that the surface of the roller shows an even surface in the nip. However, since the slots are open substantially about the entire periphery of the roller, there is still a tendency for toner and other debris to accumulate in the slots, thus increasing the likelihood that copy sheets passed through the fuser roller nip will pick up debris which is scavenged out of the slots by the stripper members. In this regard, it should be noted that in the embodiment shown in FIG. 1 of the British specification, cleaning rollers are provided; however, these rollers only bear against the surface of the fuser roller and do not clean the slots thereof.

In the above three patents, no release material such as fuser oil is applied to the fuser roller. If such material were applied, it would also tend to accumulate in the open slots thus increasing the probability of image defects in a fused support.

SUMMARY OF THE INVENTION

According to the present invention, there is provided fuser apparatus having a fusing member in which a fused support is positively separated from the fuser member without danger of the support being jammed between the surface of the fuser member and a separating member. Image defects caused by fuser oil and other debris accumulating in open slots are also eliminated. According to an aspect of the invention, fuser apparatus is provided including a fuser member movable along a continuous path, said member having a layer with a surface for fusing a toner image carried by a support brought into contact with said surface. The layer includes at least one continuous tunnel disposed beneath the surface and a self-sealing slit communicating between said tunnel and said surface. The fuser apparatus includes a support separating member having an end configured to penetrate said slit and to follow in said tunnel as said fuser member is moved along said path in order to engage and separate a support from said fuser member after contact with the fusing surface thereof. According to another aspect of the invention, the fuser member comprises a roller having an elastomeric layer provided with an annular tunnel disposed beneath a fusing surface of the elastomeric layer and a self-sealing slit communicating between the annular tunnel and said surface.

The invention and its objects and advantages will become more apparent in the detailed description of the preferred embodiment presented below.

BRIEF DESCRIPTION OF THE DRAWINGS

In the detailed description of the preferred embodiments of the invention presented below, reference is made to the accompanying drawings, like elements having like numbers in which.

DESCRIPTION OF THE PREFERRED EMBODIMENTS

Figure 1:
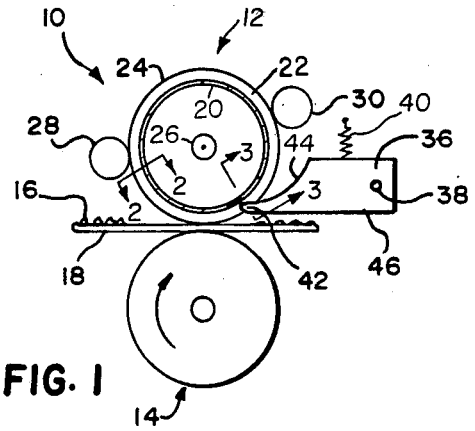
FIG. 1 is a cross-sectional side elevational view of one embodiment of fuser apparatus according to the present invention.
Figure 2:
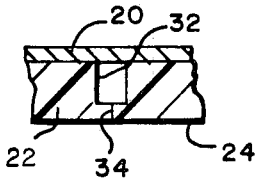
FIGS. 2 and 3 are partially sectional front elevational views of a segment of the fuser roller of FIG. 1 respectively without and with a separating member.
Figure 3:
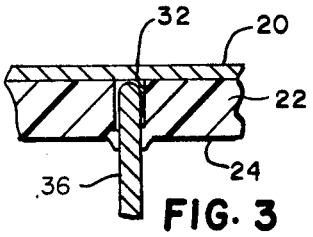

Referring now to FIGS. 1-3, there is shown a preferred embodiment of the fuser apparatus of the present invention. As shown, fuser apparatus 10 includes a fuser member such as roller 12 which forms a nip with pressure roller 14 for fusing toner images such as image 16 carried by a support 18 passed between the nip of rollers 12 and 14. Fuser roller 12 has a cylindrical core 20 of heat-conductive material such as aluminum and a resilient layer 22 of high temperature resistent elastomeric material such as silicone elastomer or fluoroelastomer which exhibits resistence to degradation over a long operating life and which has good release properties to prevent toner and other debris from sticking to the fusing surface 24 of layer 22. Roller 12 is heated internally by a heat source such as quartz lamp 26. Release material applicator 28 is provided in advance of the nip of rollers 12 and 14 to enhance the release properties of layer 22 and cleaning roller 30 is provided after the nip of rollers 12 and 14 to remove any undesirable debris which may have stuck to roller 12.

According to the present invention, fuser roller 12 is provided with at least one annular tunnel 32 (FIG. 2) in resilient layer 22 beneath the fusing surface 24 thereof. Layer 22 is also provided with a self-sealing slit 34 which communicates between tunnel 32 and surface 24.

In order to positively separate a support 18 from contact with fuser roller 12, support-separating member 36 is pivotally mounted on journal 38 and biased into engagement with fuser roller 12 by means of spring 40. Member 36 has a free end 42 which is configured to penetrate slit 34 and follow in tunnel 32 as roller 12 is rotated in a counter-clockwise direction. End 42 of member 36 is rounded to facilitate following within tunnel 32. Separating member 36 has an edge 44 which terminates at end 42 and which is adapted to penetrate through slit 34 in sealing engagement therewith (FIG. 3) to substantially prevent fuser oil, toner and other debris on the surface of roller 12 from penetrating into tunnel 32.

Member 36 is also provided with an edge 46 terminating at end 42 for engaging and separating support 18 from roller 12 and for guiding it away from apparatus 10. Member 36 is spaced from the nip between rollers 12 and 14 and edge 46 is thus located above the path of support 18.

Figure 4:
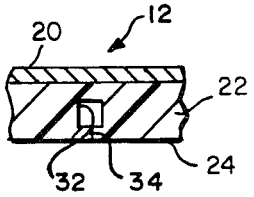
FIGS. 4 and 5 are other embodiments of tunnels which may be used in the fuser apparatus of FIG. 1.

As shown in FIG. 2, tunnel 32 has a depth such that layer 20 closes off one side thereof. However, tunnel 32 may have any depth and as shown in FIG. 4 the depth of tunnel 32 is substantially less than the thickness of layer 22.

Figure 5:
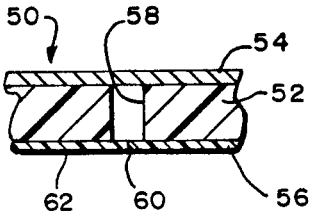

Moreover, the fuser roller may have more than one resilient layer. As shown in FIG. 5, fuser roller 50 has an underlayer 52 on a core 54 of heat-conductive material and an outer layer 56. Layer 52 is provided with a tunnel 58, substantially the thickness thereof and layer 56 is provided with a self-sealing slit 60 communicating between tunnel 58 and fusing surface 62 of layer 56. Layers 52 and 56 preferably comprise elastomeric material such as silicone elastomer or fluoroelastomer, although other resilient materials may be used.

Figure 6:
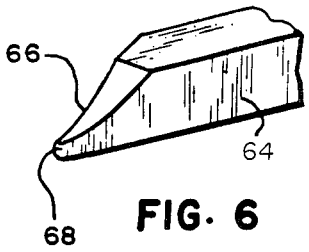
FIG. 6 is another embodiment of separating member which may be used in the fuser apparatus of FIG. 1.

FIG. 6 shows another embodiment of separating member which may be used in practicing the present invention. As shown, separating member 64 includes a beveled edge 66 terminating in rounded end 68 which is adapted to follow in tunnel 32 of roller 12. Edge 66 provides better sealing contact with the edges of slit 34 to better prevent fuser oil and other debris from penetrating into tunnel 32.

The invention is described in detail with particular reference to the preferred embodiment thereof, but it will be understood that variations and modifications can be effected within the spirit and scope of the invention.

What is claimed is:

1. Fuser apparatus comprising:

a fuser member movable along a continuous path, said member having a layer with a surface for fusing a toner image carried by a support brought into contact with said surface, said layer including at least one continuous tunnel disposed beneath said surface and a self-sealing slit communicating between said tunnel and said surface; and a support separating member having an end configured to penetrate said slit and to follow in said tunnel as said fuser member is moved around said path in order to engage and separate the support from said fuser member after contact with the fusing surface thereof.

2. The fuser apparatus of claim 1 wherein said fuser member is a roller having an elastomeric layer with a fusing surface, said elastomeric layer including at least one annular tunnel disposed beneath said surface and a self-sealing slit communicating between said annular tunnel and said fusing surface.

3. A roller fuser comprising first and second rotatable rollers forming a nip for fusing a toner image carried by a support passed through said nip;

at least one of said rollers having a layer with a fusing surface, said layer including at least one annular tunnel disposed beneath said surface and a self-sealing slit communicating between said annular tunnel and said fusing surface; and a support-separating member having an end configured to penetrate said slit beyond said nip and to follow in said tunnel as said at least one roller is rotated to engage and separate from such one roller a support as it exits from said roller nip.

4. The roller fuser of claim 3 wherein said separating member includes a rounded end to facilitate following in said tunnel.

5. The roller fuser of claim 3 wherein said separating member includes a beveled edge adapted to penetrate said slit in self-sealing engagement.

* * * * *